US008710338B2

(12) United States Patent
Galatas

(10) Patent No.: US 8,710,338 B2
(45) Date of Patent: Apr. 29, 2014

(54) APPARATUS FOR TUNING A MUSICAL INSTRUMENT, AND A RELATED INSTRUMENT

(76) Inventor: David E. Galatas, Raleigh, NC (US)

( * ) Notice: Subject to any disclaimer, the term of this patent is extended or adjusted under 35 U.S.C. 154(b) by 264 days.

(21) Appl. No.: 13/297,836

(22) Filed: Nov. 16, 2011

(65) Prior Publication Data

US 2013/0118335 A1 May 16, 2013

(51) Int. Cl.
*G10D 3/00* (2006.01)

(52) U.S. Cl.
USPC ..... 84/299

(58) Field of Classification Search
USPC ..... 84/267, 297 R, 298, 299, 313, 300–302
See application file for complete search history.

(56) References Cited

U.S. PATENT DOCUMENTS

| | | | | |
|---|---|---|---|---|
| 4,497,236 | A | 2/1985 | Rose | |
| 4,555,970 | A | 12/1985 | Rose | |
| 4,882,967 | A | 11/1989 | Rose | |
| 4,967,631 | A | 11/1990 | Rose | |
| 5,123,324 | A | 6/1992 | Rose | |
| 5,233,123 | A | 8/1993 | Rose et al. | |
| 5,355,759 | A * | 10/1994 | Hoshino | 84/298 |
| 5,522,299 | A | 6/1996 | Rose | |
| 6,046,393 | A | 4/2000 | Rose | |
| 6,046,397 | A | 4/2000 | Rose | |
| 6,051,773 | A | 4/2000 | Rose | |
| 6,111,176 | A | 8/2000 | Rose | |
| 6,137,039 | A | 10/2000 | Rose | |
| 6,194,645 | B1 | 2/2001 | Rose | |
| 6,198,030 | B1 | 3/2001 | Rose | |
| 7,045,693 | B2 | 5/2006 | Rose | |
| 7,183,475 | B2 | 2/2007 | Van Halen | |
| 2003/0094087 | A1 * | 5/2003 | Gregory | 84/267 |

OTHER PUBLICATIONS

D-tuna product website, http://www.dtuna.com/, last accessed Jan. 3, 2012.
StewMac The Key product website, http://www.stewmac.com/shop/Tools/Specialtools_for_Bridges/The_Key.html, last accessed Jan. 3, 2012.
Steinberger Transtrem (type 2) product website, http://www.steinbergerworld.com/instructions/TT-disassembly.PDF, last accessed Jan. 3, 2012.

* cited by examiner

*Primary Examiner* — Kimberly Lockett
(74) *Attorney, Agent, or Firm* — NK Patent Law, PLLC

(57) ABSTRACT

An apparatus for tuning a stringed musical instrument is provided. The apparatus includes a saddle configured for receivably engaging one of the ends of the string, a fastener extending through a support and into the saddle, and a lug received by the fastener in abutting relationship to the support and configured for rotational movement about the fastener to translate the fastener and the saddle to alter the length of the string.

21 Claims, 8 Drawing Sheets

APPARATUS FOR TUNING A MUSICAL INSTRUMENT, AND A RELATED INSTRUMENT

TECHNICAL FIELD

This disclosure is related to an apparatus for tuning a musical instrument, and more particularly towards an apparatus for tuning a musical instrument by altering the length of a string of the musical instrument, and also towards a musical instrument having one or more tuning apparatuses disclosed herein.

BACKGROUND

Acquiring the proper tune for a musical instrument is of utmost importance in achieving a pleasing musical performance. For musical instruments having strings such as a guitar, there are two types of string tuning. One type of tuning is referred to as pitch or fine tuning, which is accomplished by increasing or decreasing the tension on a given string, thereby raising or lowering, respectively, the pitch of the string. The other type of string tuning is referred to as harmonic or string length tuning, commonly referred to as intonation, which is accomplished by altering the distance between the points at which a given string contacts the bridge and nut elements of the instrument.

It is also known that clamping devices incorporated at the bridge and nut of the instrument greatly increase the length of time an instrument will remain pitched tuned, however, these devices may be cumbersome to tune and/or intonate. For example, some conventional tuning devices require the user to loosen a fastener that is maintaining a saddle into which the string is received in order to move the saddle to increase or decrease the string length. The saddle is then slid forward or backward until the desired string length is reached. The fastener is then tightened in order to secure the saddle in place. During the process of tightening the fastener, the saddle may move thereby resulting in an undesirable string length and a musical instrument that is not in tune or a desired intonation.

Accordingly, a need exists for an improved device or apparatus which can achieve a more efficient tuning by altering the length of a string of the musical instrument.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is an apparatus for tuning a stringed musical instrument. The apparatus includes a saddle configured for receivably engaging one of the ends of the string, a fastener extending through a support and into the saddle, and a lug received by the fastener in abutting relationship to the support and configured for rotational movement about the fastener to translate the fastener and the saddle to alter the length of the string.

According to one or more embodiments, the support includes a tension adjuster that engages the fastener to alter the tension of the string by rotation of the saddle about a pivot.

According to one or more embodiments, the lug defines a recess for receiving the tension adjuster.

According to one or more embodiments, the lug defines an internally threaded portion that engages an externally threaded portion of the fastener.

According to one or more embodiments, the support defines a flat portion upon which the saddle rests, a post that is configured for being receivably engaged within the instrument, and a hangar configured for extending from a base of the instrument, the hangar including the tension adjuster.

According to one or more embodiments, the hangar defines an angled portion and the lug defines a correspondingly beveled portion configured for abutting relationship with the angled portion.

According to one or more embodiments, the apparatus includes a spring extending from the flat portion into the recess of the lug for biasing the lug towards the string.

According to one or more embodiments, the saddle comprises a fastener that extends into the instrument or bridge for positioning the saddle in a position corresponding to a desired string length.

According to one or more embodiments, the apparatus includes a tremolo bar that is configured for pivoting the apparatus about the instrument to adjust the tune thereof.

According to one or more embodiments, an apparatus for tuning a stringed musical instrument is provided. The apparatus includes string engaging means for engaging one of the ends of the string, length adjusting means for engaging altering the position of the string engaging means to a position corresponding to a desired string length, and a lug received by the length adjusting means and configured for rotational movement about the length adjusting means to translate the string engaging means to alter the length of the string.

According to one or more embodiments, a guitar is provided. The guitar includes a body having a bridge carried thereon, a neck extending from the body, and a head defined on a free end of the neck. At least one string extends from the head to the bridge. An apparatus for tuning the string is provided. The apparatus includes a saddle configured for receivably engaging one of the ends of the string, a fastener extending through a support and into the saddle for engaging the string to the saddle, and, a lug received by the fastener in abutting relationship to the support and configured for rotational movement about the fastener to translate the fastener and the saddle to alter the length of the string.

According to one or more embodiments, a lug for tuning a stringed instrument of the type having a tuning apparatus that includes a saddle configured for receivably engaging an end of a string and a fastener extending through a support and into the saddle for engaging the string to the saddle is provided. The lug is configured to be received by the fastener in abutting relationship to the support and configured for rotational movement about the fastener to translate the fastener and the saddle to alter the length of the string.

According to one or more embodiments, the tuning apparatus is of the type that includes a tension adjuster that engages the fastener to alter the tension of the string by rotation of the saddle about a pivot, and the lug defines a recess for receiving the tension adjuster.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Although the one or more embodiments disclosed herein are shown in use on an electric guitar, it should be understood that the one or more embodiments can be used on other stringed instruments, including, for example the cello, banjo, and even the piano. The one or more embodiments may probably have its greatest use, however, on a guitar and hence is so described. Further, although the one or more embodiments are described and shown as a guitar bridge element, it should be understood that the one or more embodiments could be adapted for use as the nut element of the guitar as well. Additionally, guitars may take on a variety of configurations, all of which are suitable for use with the one or more devices disclosed herein.

Guitar strings are both harmonically tuned and pitch tuned. The harmonic tune of the strings may be changed by changing the distance between the last contact point of the string on the nut, i.e. the contact point nearest the bridge, and the first contact point on the bridge, i.e. the contact point nearest the nut. These are referred to hereinafter as the critical contact points of the instrument's strings. This process may also be referred to as intonation. Harmonic tuning may be accomplished, for example, by moving the bridge or the critical contact point of the string on the bridge longitudinally relative to the nut. Alternatively, harmonic tuning may also be accomplished by moving the critical contact point on the nut away from the bridge.

The strings are pitch or fine tuned by changing the tension of the strings. Ideally, this should be done without changing the distance between the nut and bridge critical contact points. The one or more embodiments disclosed herein are capable of such a result. Increasing the tension of the string raises the pitch of the string, while decreasing the string's tension lowers a string's pitch.

Figure 1:
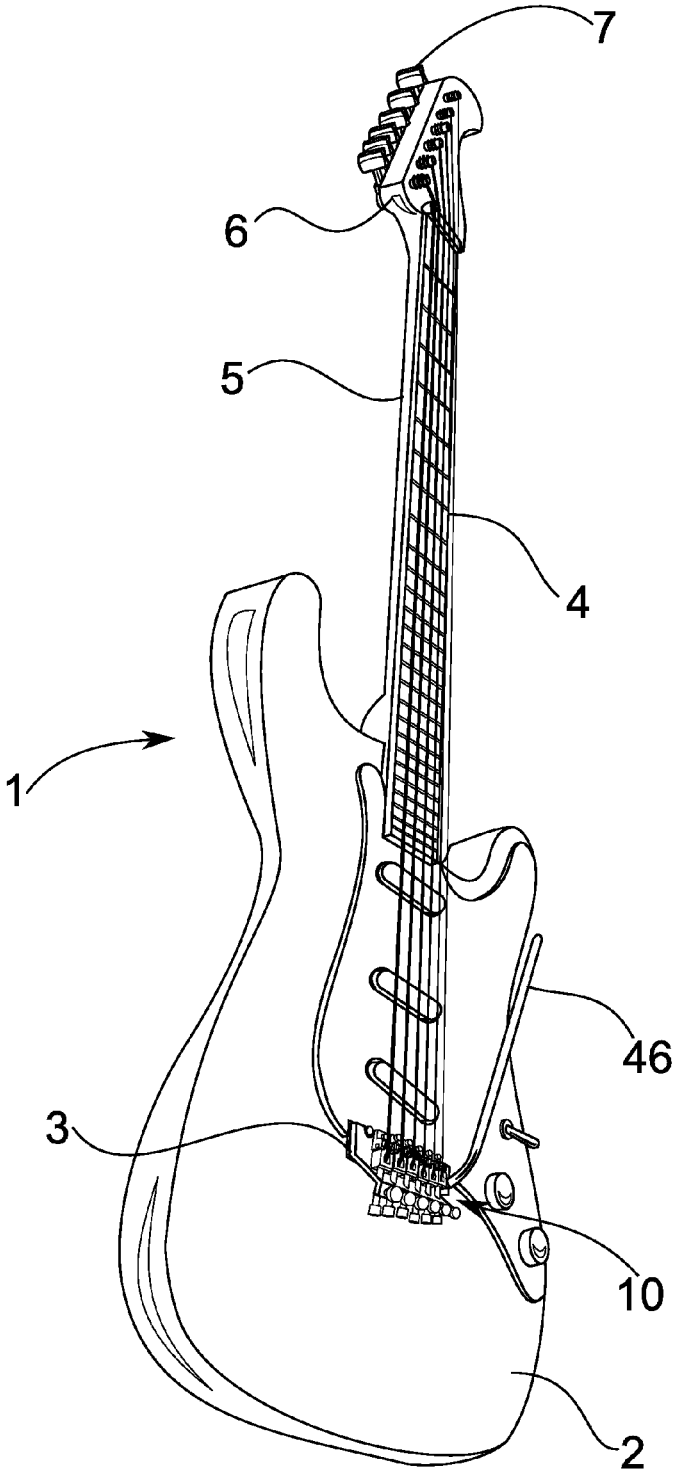
FIG. 1 illustrates a perspective view of a stringed musical instrument, namely a guitar, for use with one or more tuning apparatuses disclosed herein.

FIG. 1 illustrates a stringed instrument which is illustrated as a guitar 1 throughout the drawings. The guitar 1 includes a body 2 having a bridge 3 carried thereon. The bridge 3 is provided to act as a critical contact point and to transfer vibration from the strings 4 to the soundboard. The strings 4 extend from the bridge 3 along the neck 5 to the head 6. The head 6 includes one of a peghead, tuning key, tuning machine, tuners 7, or the like for tuning the strings 4. The guitar 1 may further include a conventional tremolo bar 46 for altering the pitch of the guitar. The guitar 1 is illustrated with 6 strings, but may have any appropriately configured amount.

Figure 2:
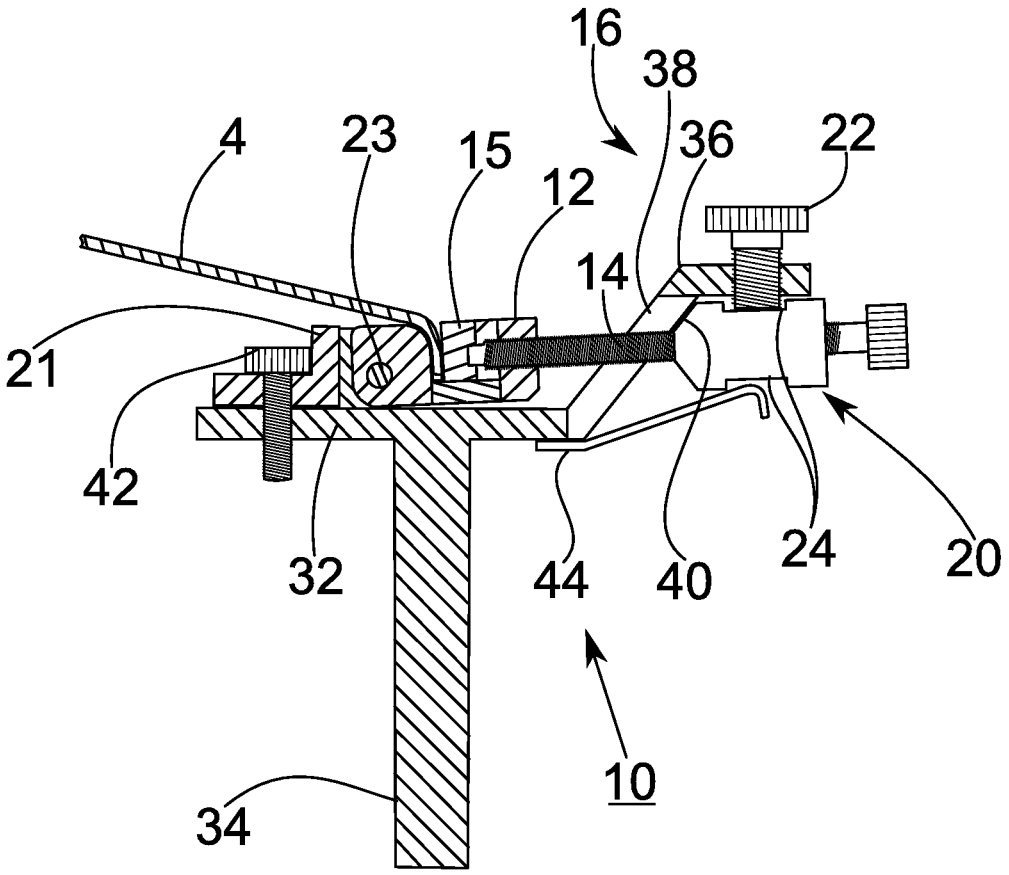
FIG. 2 illustrates a partial cross-sectional view of one or more tuning apparatuses disclosed herein.
Figure 3A:
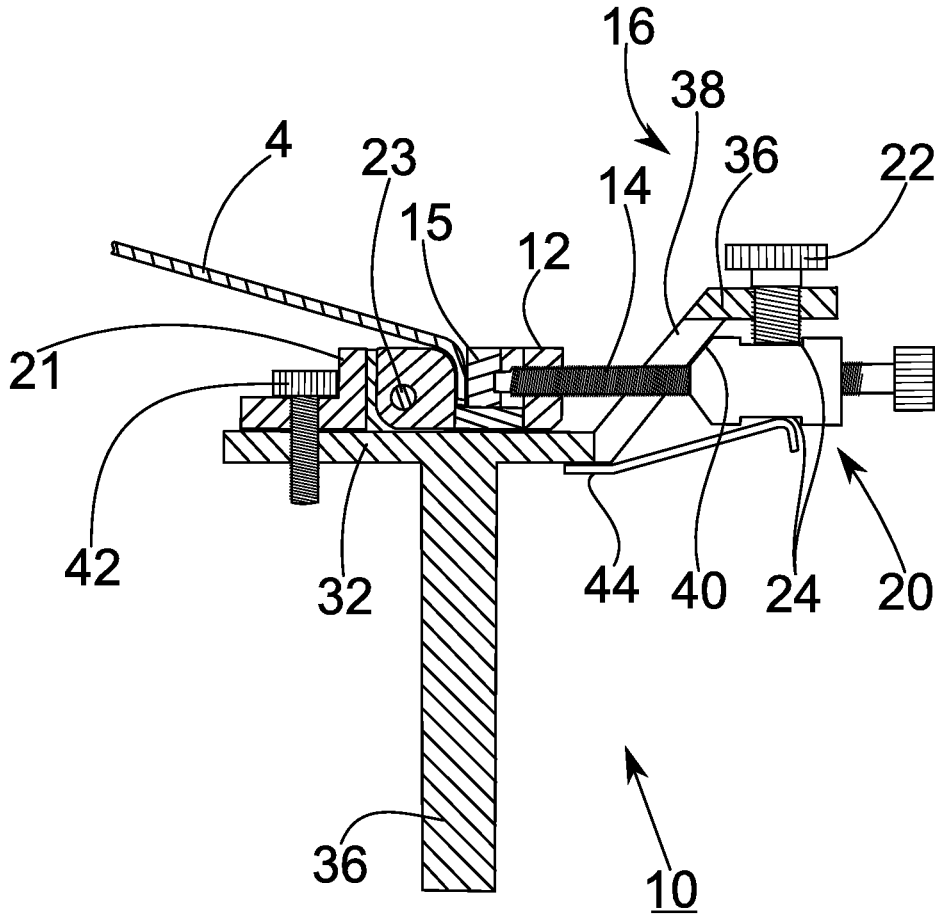
FIG. 3A illustrates a partial cross-sectional view of one or more tuning apparatuses in a first position.
Figure 3B:
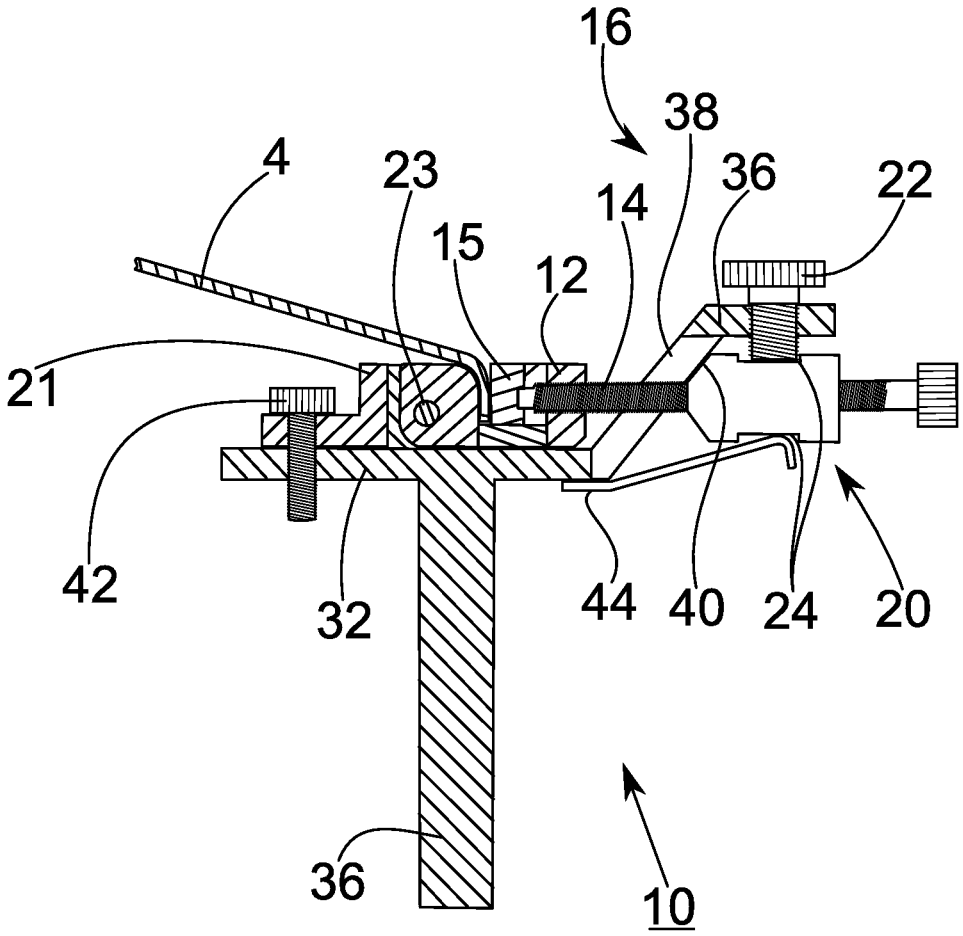
FIG. 3B illustrates a partial cross-sectional view of one or more tuning apparatuses in a second position in which the length of the string is increased compared to the string length in FIG. 3A.

An apparatus for tuning a musical instrument such as the guitar 1 is disclosed herein and generally designated 10. With further reference to FIGS. 2, 3A, and 3B, the apparatus 10 includes a saddle 12 configured for receivably engaging one of the ends of the string 4. A fastener 14 extends through a support 16 and into the saddle 12. The fastener 14 may be a threaded fastener as illustrated, or may take on any appropriate configuration. The fastener 14 may be configured to engage a string clamp 15 that is carried within a recess of the saddle 12 for engaging and securing the string 4 thereto or may take any appropriate configurations.

A lug 20 is received by the fastener 14 in abutting relationship to the support 16. The lug 20 is configured for rotational movement about the fastener 14 to translate the fastener 14 and the saddle 12 to alter the length of the string 4. In this manner, the saddle 12 is moveable in a direction along the length of the neck 5. Movement of the saddle 12 towards the neck 5 shortens the length of the string 4, thereby changing the tuning of the guitar 1, whereas, movement of the saddle 12 away from the neck 5 lengthens the length of the string 4, also changing the tuning of the guitar 1.

The saddle 12 includes a fastener 42 that extends into the bridge or guitar 1 for maintaining the position of the saddle 12. The fastener 42 is loosened in order to allow for movement of the saddle 12 and then tightened in order to secure the position of the saddle 12 when a desired string length is reached. In many conventional devices, this step of positioning the saddle 12 when the desired string length is reached required the user to move the saddle 12 with their fingers or hands and then tighten the fastener 42. During this tightening step of many conventional devices, the saddle 12 may be pulled towards the neck 5 by the tension of the strings 4, thereby being out of the preferred tune.

The saddle 12 includes a pivoted joint 23 that allows the saddle 12 to pivot about portion 21. In this manner, the saddle 12 can pivot towards the guitar 1 or away from the guitar 1, thus increasing tension on the string 4 or decreasing tension of the string 4, respectively, and increasing or decreasing the pitch associated with a respective string 4. The pivoted position of the saddle 12 is adjusted by a tension adjuster 22 that extends from a flat portion 36 of the support 16 and is selectively extendable to impart movement of the fastener 14 and thus pivotable movement about the pivoted joint 23. In the one or more embodiments disclosed herein, the tension adjuster 22 is configured to engage the lug 20 and impart movement to the fastener 14.

Figure 5:
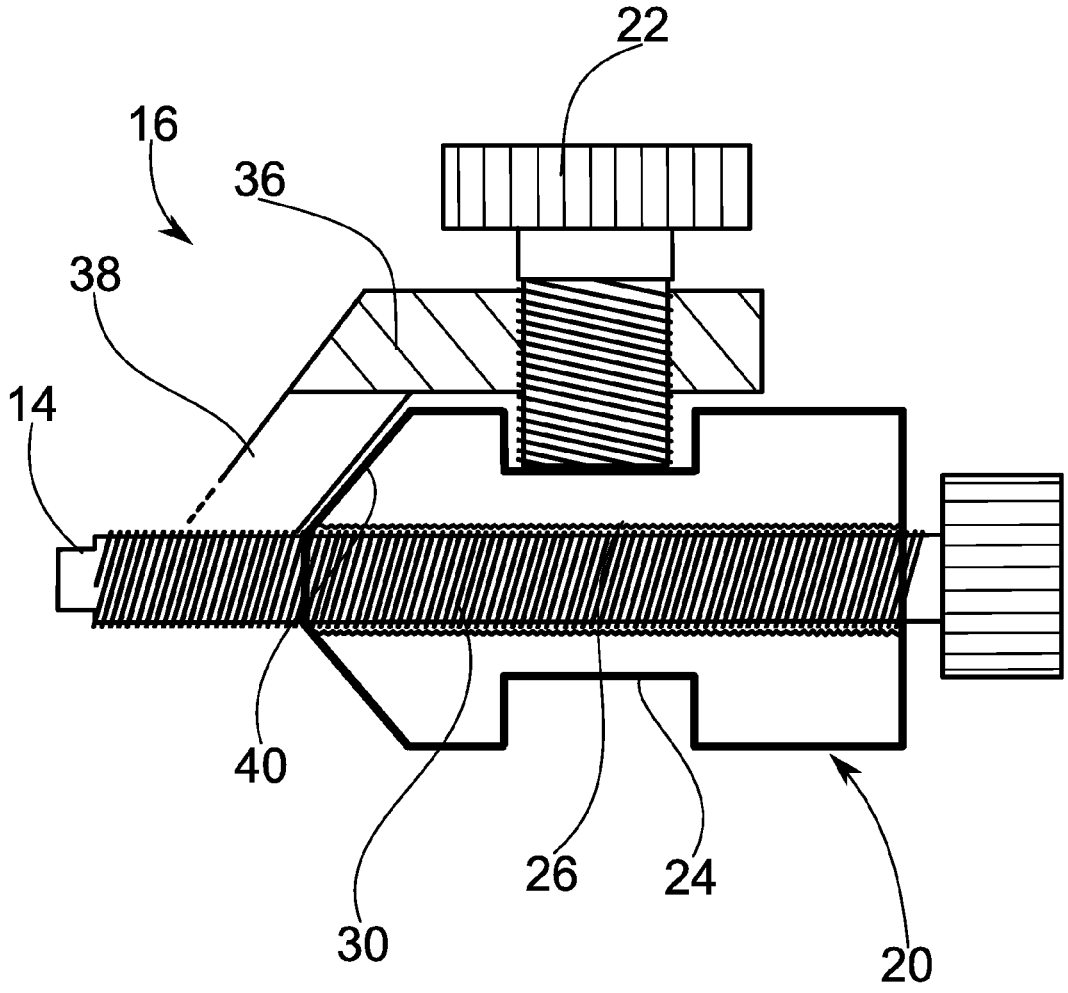
FIG. 5 illustrates an enlarged, cross-sectional view of the one or more tuning apparatuses of FIG. 2.

The lug 20 may define a recess 24 for receiving the tension adjuster 22. As illustrated in FIG. 5, the lug 20 may define an internally threaded portion 26 that engages an externally threaded portion 30 of the fastener 14.

Figure 4:
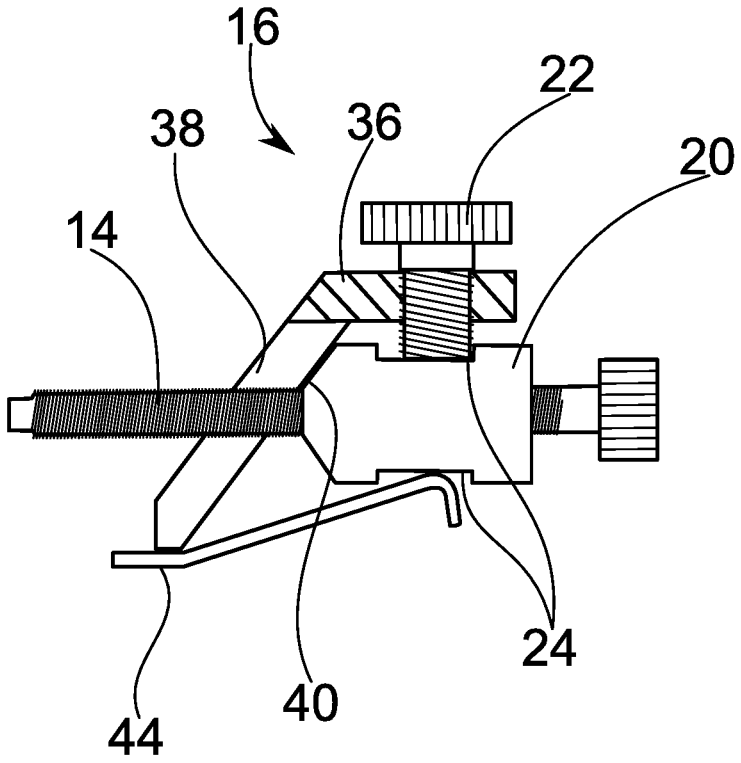
FIG. 4 illustrates an enlarged view of the one or more tuning apparatuses of FIG. 2.

The support 16 defines a flat portion 32 upon which the saddle 12 rests, a post 34 that is configured for being receivably engaged within the guitar 1, and a hangar portion 36 configured for extending from the body 2 of the guitar 1. The hangar portion 36 defines a recess that receives the tension adjuster 22. The hangar portion 36 may define an angled portion 38. The lug 20 may define a correspondingly beveled portion 40 configured for abutting relationship with the angled portion 38 as illustrated in FIG. 4.

As illustrated in each of FIGS. 2, 3A, and 3B, the tuning apparatus 10 may include a spring 44 extending from the flat portion 32. In one or more embodiments, a portion of the spring 44 may extend into the recess 24 of the lug 20 for biasing the lug 20 towards the fastener 22. The recess 24 may take on any appropriately configured shape for corresponding with a desired fastener 22 shape.

The one or more apparatuses disclosed herein, particularly the one or more embodiments of lug 20, are equally applicable to any number of available bridge and tremolo systems. For example, string engaging means for engaging one of the ends of the string and length adjusting means for altering the position of the string engaging means to a position corresponding to a desired string length may be found in for example, U.S. Pat. Nos. 4,171,661, 4,497,236, 4,549,461, and 4,967,631, all of which are hereby incorporated by reference. The tremolo bar 46 is configured to further rotate the saddle 12 to change intonation of the stringed instrument in a manner similar to that which is described in one or more of the patents that are incorporated herein.

Figure 6:
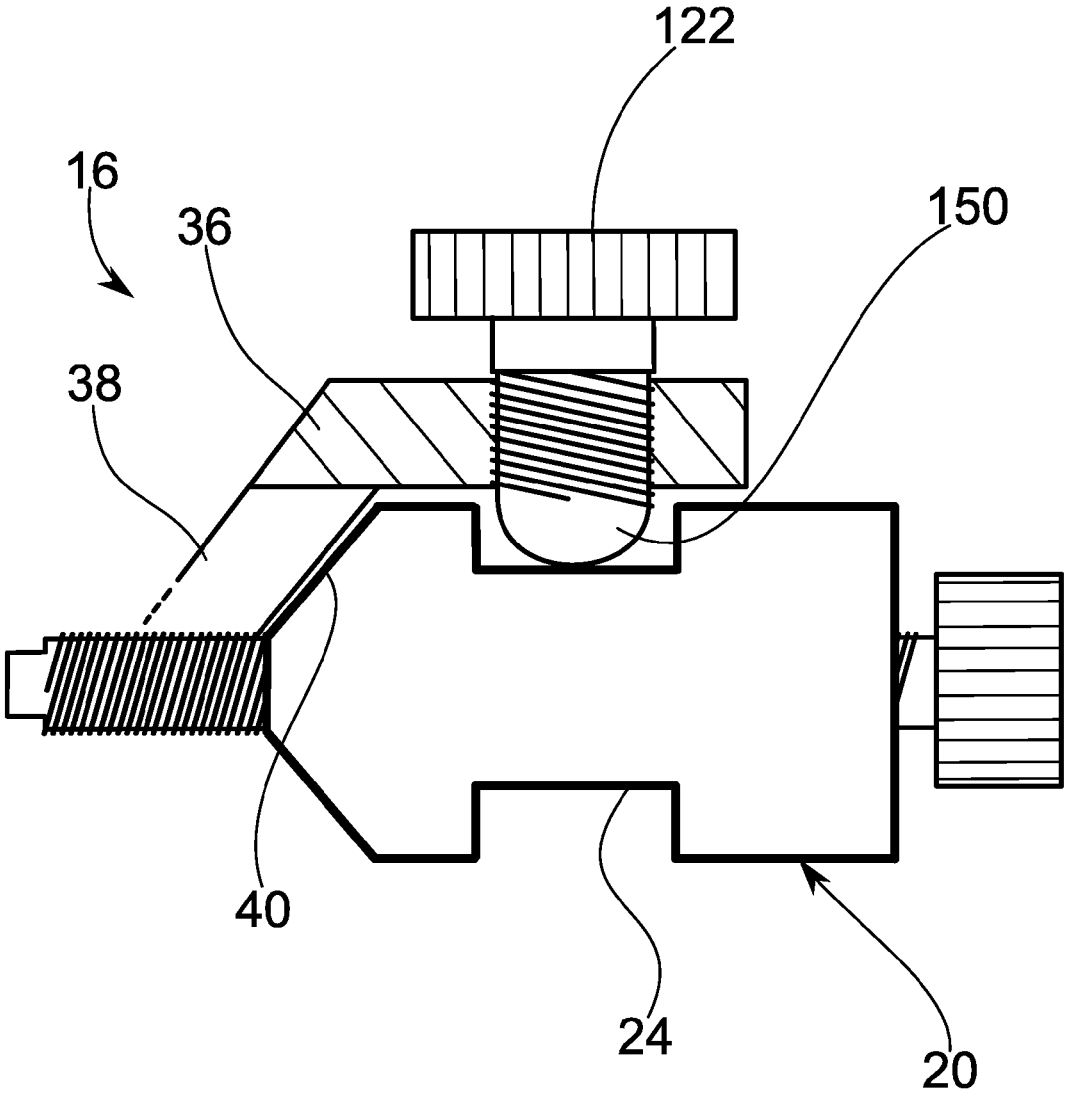
FIG. 6 illustrates one or more tuning apparatuses disclosed herein.
Figure 7:
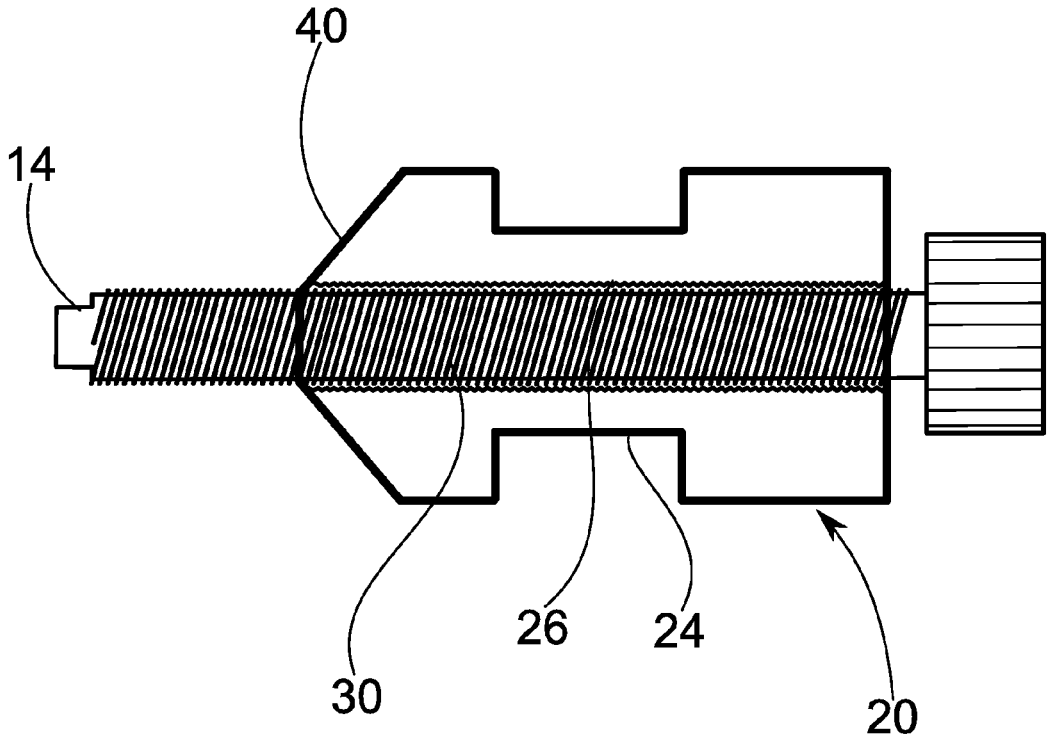
FIG. 7 illustrates one or more lugs for use with a tuning apparatus as disclosed herein.

Movement of the saddle 12 and thereby tuning of the string 4 is illustrated in FIGS. 3A and 3B in which the saddle 12 is shown in a first position in FIG. 3A and a second position in which the saddle 12 is pulled towards the lug 20 thereby alter the length of the string 4 in FIG. 3B by increasing the distance between the two critical contact points. The saddle 12 is placed in the second position by rotation of the lug 20. Rotation of the lug 20 imparts translatable movement of the fastener 14 due to the threaded engagement of a threaded portion 30 of fastener 14 and a correspondingly threaded portion 26 defined within an opening of lug 20 as illustrated in FIG. 5. One or more embodiments of lug 20 and fastener 14 are illustrated in the partial cross-sectional view of FIG. 7. One or more embodiments of a lug 20 are illustrated in FIG. 6 in which fastener 122 includes a rounded free end 150. The rounded free end 150 may allow for angular movement of the lug 20 about hangar portion 36 as opposed to the flat free end illustrated in the one or more embodiments illustrated in FIG. 5 which may not maintain a constant flush arrangement between the free end of fastener 22 and recess 24 of the lug 20. While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. An apparatus for tuning a stringed musical instrument, the apparatus comprising:

a saddle configured for receivably engaging an end of a string;

a fastener extending through a support and into the saddle; and a lug received by the fastener in abutting relationship to the support and configured for rotational movement about the fastener to translate the fastener and the saddle to alter the length of the string.

2. The apparatus of claim 1, wherein the support includes a tension adjuster that engages the fastener to alter the tension of the string by rotation of the saddle about a pivot.

3. The apparatus of claim 2, wherein the lug defines a recess for receiving the tension adjuster.

4. The apparatus of claim 1, wherein the lug defines an internally threaded portion that engages an externally threaded portion of the fastener.

5. The apparatus of claim 1, wherein the support defines a flat portion upon which the saddle rests, a post that is configured for being receivably engaged within the instrument, and a hangar configured for extending from a base of the instrument, the hangar including the tension adjuster.

6. The apparatus of claim 5, wherein the hangar defines an angled portion and the lug defines a correspondingly beveled portion configured for abutting relationship with the angled portion.

7. The apparatus of claim 5, further including a spring extending from the flat portion into the recess of the lug for biasing the lug towards the string.

8. The apparatus of claim 1, wherein the saddle comprises a fastener that extends into the instrument for positioning the saddle in a position corresponding to a desired string length.

9. The apparatus of claim 1, further including a tremolo bar that is configured for pivoting the apparatus about the instrument to adjust the tune thereof.

10. A guitar comprising:

a body having a bridge carried thereon, a neck extending from the body, and a head defined on a free end of the neck;

at least one string extending from the head to the bridge; and an apparatus for tuning the string, the apparatus comprising:

a saddle configured for receivably engaging an end of a string;

a fastener extending through a support and into the saddle for engaging the string to the saddle; and a lug received by the fastener in abutting relationship to the support and configured for rotational movement about the fastener to translate the fastener and the saddle to alter the length of the string.

11. The guitar of claim 10, wherein the support includes a tension adjuster that engages the fastener to alter the tension of the string by rotation of the saddle about a pivot.

12. The guitar of claim 11, wherein the lug defines a recess for receiving the tension adjuster.

13. The guitar of claim 10, wherein the lug defines an internally threaded portion that engages an externally threaded portion of the fastener.

14. The guitar of claim 10, wherein the support defines a flat portion upon which the saddle rests, a post that is configured for being receivably engaged within the instrument, and a hangar configured for extending from a base of the instrument, the hangar including the tension adjuster.

15. The guitar of claim 14, wherein the hangar defines an angled portion and the lug defines a correspondingly beveled portion configured for abutting relationship with the angled portion.

16. The guitar of claim 14, further including a spring extending from the flat portion into the recess of the lug for biasing the lug towards the string.

17. The guitar of claim 10, wherein the saddle comprises a fastener that extends into the instrument for positioning the saddle in a position corresponding to a desired string length.

18. The guitar of claim 10, further including a tremolo bar that is configured for pivoting the apparatus about the instrument to adjust the tune thereof.

19. A lug for tuning a stringed instrument of the type having a tuning apparatus that includes a saddle configured for receivably engaging an end of a string and a fastener extending through a support and into the saddle for engaging the string to the saddle, the lug being configured to be received by the fastener in abutting relationship to the support and configured for rotational movement about the fastener to translate the fastener and the saddle to alter the length of the string.

20. The lug of claim 19, wherein the tuning apparatus is of the type that includes a tension adjuster that engages the fastener to alter the tension of the string by rotation of the saddle about a pivot, and wherein the lug defines a recess for receiving the tension adjuster.

21. The lug of claim 20, wherein the lug defines an internally threaded portion that engages an externally threaded portion of the fastener.

* * * * *